United States Patent [19]

Oja

[11] Patent Number: 4,699,597

[45] Date of Patent: Oct. 13, 1987

[54] PUMP ATTACHMENT FOR OUTBOARD MOTORS

[76] Inventor: Ray V. Oja, 210 Alexmuir Blvd. #90, Scarborough, Ontario, Canada

[21] Appl. No.: 858,164

[22] Filed: Apr. 29, 1986

[51] Int. Cl.[4] ..... B63H 1/28

[52] U.S. Cl. ..... 440/66; 440/49; 440/39; 239/289

[58] Field of Search ..... 440/66, 67, 71, 72, 440/38, 39, 47, 49, 900; 416/146 R, 189, 214 R, 215, 247 R, 247 A; 239/289

[56] References Cited

U.S. PATENT DOCUMENTS

| | | | |
|---|---|---|---|
| 3,139,060 | 6/1964 | Dane | 440/39 |
| 3,149,605 | 9/1964 | Broadwell | 440/67 |
| 3,339,516 | 12/1965 | Lenci | 440/39 |
| 3,613,630 | 10/1971 | Jacuzzi | 440/39 |
| 4,106,425 | 8/1978 | Gruber | 440/72 |

FOREIGN PATENT DOCUMENTS

| | | | |
|---|---|---|---|
| 664183 | 6/1963 | Canada | 440/39 |

*Primary Examiner*—Jeffrey V. Nase
*Assistant Examiner*—Edwin L. Swinehart
*Attorney, Agent, or Firm*—Paul H. Gallagher

[57] ABSTRACT

A shell made up of opposed halves is fitted over the propeller screw of the motor on the boat. This shell then becomes an enclosure with inlet and outlet openings at the ends. This shell with the propeller screw forms a pump with the propeller screw pumping water through the shell and through an outlet hose which is extended to the shore. One form has the inlet and outlet openings on the axis of the propeller screw and other forms include the outlet arranged tangentially or angularly. A hose can be connected to the inlet opening for bailing a boat.

8 Claims, 10 Drawing Figures

PUMP ATTACHMENT FOR OUTBOARD MOTORS

FIELD OF THE INVENTION

The invention relates to a fire pump for use on a motorboat. It is in the form a separate unit, applied to the motorboat while the motorboat is in the water, for pumping the water to a point at a distance. Its uses include such things as fighting fires on the shore edge, flooding, sprinkling lawns and gardens, etc.

OBJECTS OF THE INVENTION

A broad object of the invention is to provide a pump unit that can be applied to a motorboat while the motorboat is in the water, for pumping the water thereby.

Another object is to provide a pump of the foregoing character having the following features and advantages:

1. It can be applied very quickly whereby to minimize damage that is at that time occurring, such as in the case of a fire.

2. It is compact, light in weight, and small in size, whereby to facilitate applying it to the motorboat, and whereby it can easily be applied, even by a small person or child.

3. Its design and construction are such that it can be adapted to substantially any kind of motorboat, and without modifying the motorboat in any way.

4. It is very inexpensive to make, and thus well within cost range for substantially all motorboat owners.

DESCRIPTION OF A PREFERRED EMBODIMENT

Figure 1:
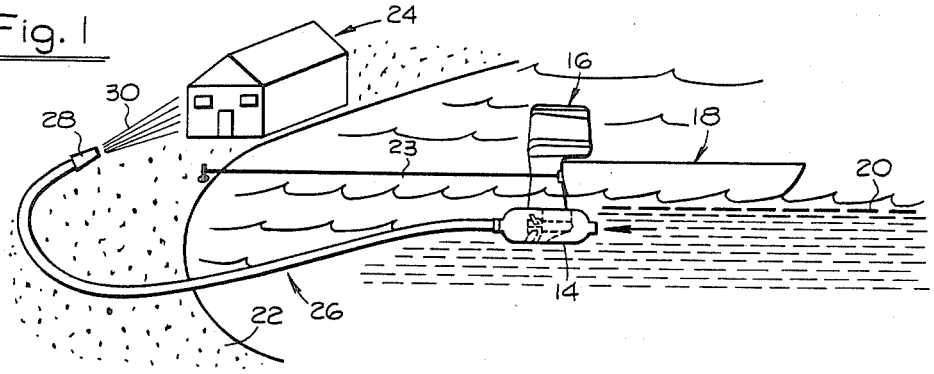
FIG. 1 is a perspective view showing the pump unit of the invention applied to a boat, and in conjunction with other features, of the landscape, where the boat is located.

Referring to the invention in general, and the background or surroundings in which the device is used, attention is directed to FIG. 1. This figure shows a pump unit 14 made according to the invention, applied to the motor 16 of a motorboat 18. The boat 18 is shown lying in a body of water 20, the shore of which is indicated at 22. The boat is anchored by a suitable line 23, against the action of pumping the water, as described hereinbelow. The numeral 24 indicates a building on the shore which represents a principal use of the device, that is in the case of a fire close to the water, the emergency pump provided by the present invention may be utilized for pumping the water from the body 20 for extinguishing the fire in the building 24. The emergency pump includes an outlet hose or conduit 26 through which the water is pumped, having a nozzle 28 directing the stream of water 30 onto the building.

The specific device of the present invention in itself is not a pump, but as applied to the motor of the motorboat, it forms such a pump, in conjunction with the propeller screw of the boat.

The device of the invention is adaptable to use with boats of various kinds, since it is applied essentially only to the propeller. Although the example of the boat in the present application is of outboard motor kind, the device is applicable to other types such as inboard/outboard or stern drive forms. In all cases the propeller is of course exterior to the boat, and in the water, and the immediate construction incorporating the propeller is similar in most cases if not all cases. In the case of an inboard engine, the engine is ordinarily of much greater power than an outboard motor and thus exemplifies one aspect of the usefulness of the invention, namely, by means of a relatively small and lightweight device (principally a shell) the enormous power of the engine is utilized for pumping great quantities of water and to a great distance. Furthermore, the device can be dimensioned and designed to accommodate any large boats, including for example yachts. In all cases, the portion of the engine or motor or power plant that directly incorporates the propeller is of such construction and form that the device of the invention can be easily predesigned to fit any such construction. While the example of boat in the present case is an outboard type, and the detail description is written to apply to such specific construction, it will be understood that the detail construction of the shell is an example of the various kinds that can be utilized.

Referring again to FIG. 1, the boat 18, as indicated above, is an outboard motorboat, i.e. the motor 16 being attached to the boat, and extending downwardly into the water. It will be understood that in the use of the device of the invention, the boat normally is resting in the water with the propeller uncovered, i.e., ready for propelling the boat as desired. The device of the present invention, when an emergency develops, is applied to the motor, and then the emergency pump is formed or produced. The device of the invention is basically a shell which encloses the propeller screw of the motor, and certain other adjacent elements.

Figure 2:
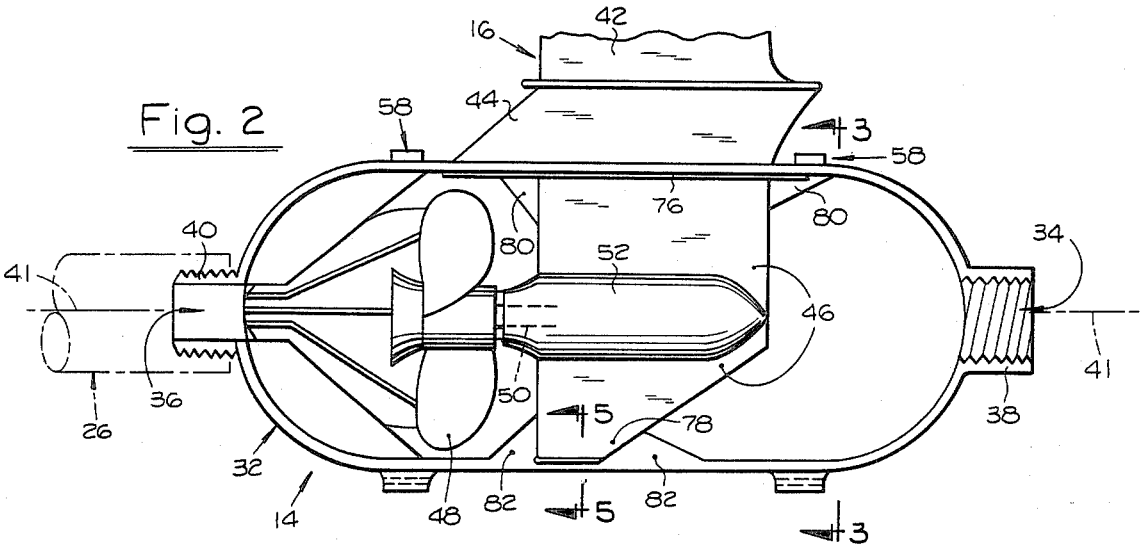
FIG. 2 is a large scale, axial sectional view of the unit as applied in FIG. 1 in showing certain elements of the motorboat to which it is applied.
Figure 3:
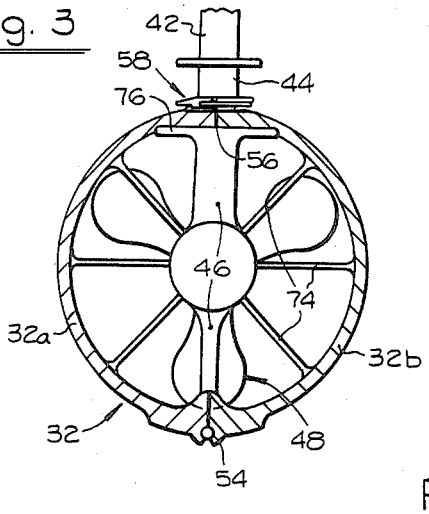
FIG. 3 is a cross sectional view taken at about the line 3—3 of FIG. 2.
Figure 8:
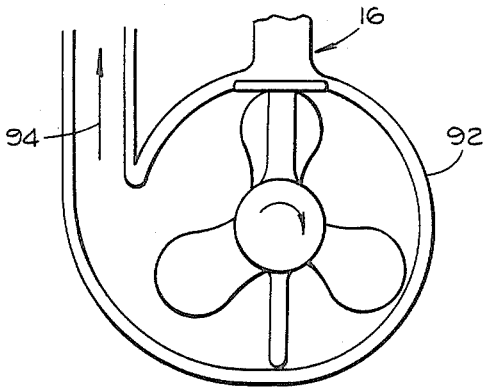
FIG. 8 is a cross sectional view of an emergency pump having a tangential outlet.

Attention is directed to FIGS. 2 and 3, in conjunction with FIG. 1 for a description of the detail construction of the device. The device itself, identified above as 14, includes a shell 32 which is made up of a pair of opposite halves (FIG. 3) 32*a*, 32*b*. The shell may be of any suitable material, preferably a plastic material that may be molded. The halves are substantially identical, but opposite and symmetrical, and the shell is shaped in generally cylindrical form, but having end portions of suitable shape, such as spherical as shown here, or conical or tapered as desired. It has an inlet opening 34 and an output or outlet opening 36, these surrounded by tubular elements 38, 40, respectively. In this case, the inlet and outlet openings are arranged on the axis 41 of the shell, but compare the construction of FIGS. 8 and 9.

The outboard motor 16 is of known kind, and includes a lower portion or exhaust housing 42 which has a lower unit 44.

The motor includes the usual propeller 48 mounted on a shaft 50, mounted in a gear housing or gearcase 52 which may be integral with the lower unit 44. This gearcase 52 may be generally cylindrical in shape, but it is pointed out that it is of a width only a small portion of the diameter, i.e. width, (FIG. 3) of the shell.

The shell when mounted on the motor as shown in FIGS. 1–3 forms, with the propeller or screw 48, the emergency pump of the invention. The propeller 48 constitutes a propeller in the normal use of propelling the boat along the water, but as used in the emergency pump formed by the present invention, it becomes an impeller in that the boat remains stationary and the water is impelled through the shell and outlet hose 26. The halves 32*a*, 32*b*, of the shell are preferably hinged as at 54 at the bottom and when they are fitted together, their swinging edges interengage at 56 in a diametrical plane containing the hinge 54 and the axis 41.

Figure 4:
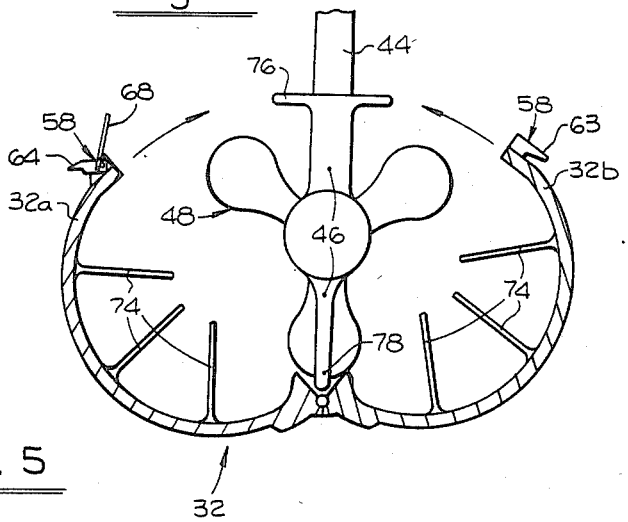
FIG. 4 is a view similar to FIG. 3, but with the parts of the pump unit in spread position.
Figure 5:
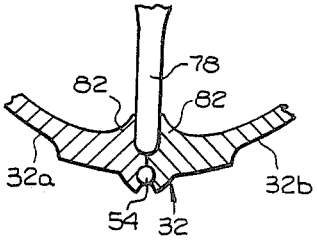
FIG. 5 is a sectional view taken at line 5—5 of FIG. 2.
Figure 6:
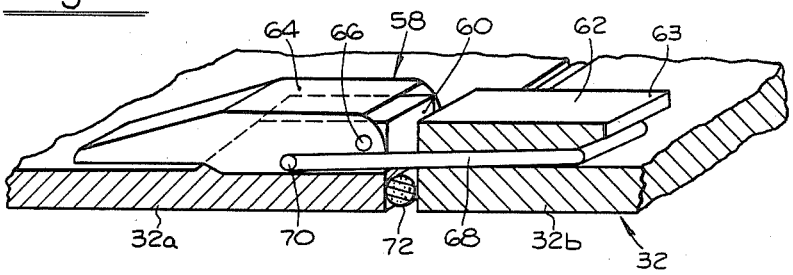
FIG. 6 is a cross sectional detail view of a snap lock for releasably locking the parts of the unit together when applied to the motorboat.

To apply the shell to the motor, it is manipulated as represented in FIG. 4, i.e., the halves of the shell are swung apart and brought up from the bottom over the propeller and then swung together into enclosing position as shown in FIG. 3. The shell is provided with a quick-acting snap lock shown in FIG. 6, and identified 58. This snap lock is of known kind, and for mounting it, the shell halves are provided with elements 60, 62 preferably formed integral therewith, the element 62 having a hook or lip 63. A lever 64 is pivoted at 66 on the element 60, and a bail 68 is pivoted at 70 on the lever. The operation of the lock is simple—to lock it, the lever 64 is raised, the bail 68 hooked under the lip 63, and then the lever is swung down to locked position shown in FIG. 6, and in this position the bail 68 lies below the pivot point 66, holding it in such locked position. The lip 63 securely holds the bail in locked position, preventing it from accidentally swinging to open position. The lock is unlocked by reversing the steps mentioned, whereupon the shell halves are separable for removing the shell from the motor. The number 72 represents a suitable sealing means between the shell halves for sealing the interior, referred to as an "O ring", although in this case it is made up of two parts because the shell is made up of separable parts.

Preferably the shell includes in its interior, adjacent the outlet end, a plurality of radial vanes 74 for assisting in directing the water throught he shell in straight longitudina! direction, particularly at the outlet. These vanes may extend from the outlet rearwardly to a position adjacent the impeller 48. However, these vanes are not utilized in the case of a tangential outlet, as in FIG. 8.

Reference is made next to the specific construction of the shell to fit certain constructional elements of the motor. It is not necessary to alter, or otherwise adapt, the motor to the shell. The motor, in its standard form, includes a cavitation plate 76 at the bottom of the lower portion 42 and the latter includes a skeg 78 which is of reduced dimensions.

The swinging edges of the shell halves 32*a*, 32*b*, are fitted over the cavitation plate 76, and the shell halves are provided with internal positioning lugs 80 engaging the front and rear edges of the lower unit 44. Similarly the shell is provided with positioning lugs 82 at the bottom engaging the skeg 78. These positioning lugs at both the top and bottom, include elements on each of the shell halves, and in response to the shell being fitted to the motor, the lugs come into proper holding position, i.e., those on the two halves are fitted on opposite side surfaces of the lower unit 44. The lugs 82 also are arranged for engaging the front and rear edges of the skeg 78, the rear edge of the latter being inclined. Consequently the shell is held securely and rigidly against displacement in all directions. The cavitation plate 76 supports the shell from moving downwardly; the positioning lugs 80, 82, engage the lower unit on each of four sides, i.e. both lateral sides and front and rear; consequently the shell is held against displacement vertically, longitudinally or axially, and rotationally.

In the normal use of the device, the inlet opening 34 may remain as shown in FIGS. 1 and 2, i.e., without a hose or conduit secured thereto. However in the case of the outlet, the hose 26 identified above is fitted on the tubular element 40. This hose is of course of the desired length to reach the intended objective.

When it is desired to use the motor for pumping water, the shell 32 is applied to the motor as described above. This can be applied very quickly, and it can be done easily, even by a small person, or a child. The pump unit, or shell, is small and compact, being preferably only slightly larger than the diameter of the propeller, the latter in the case of large motors being of about 16" diameter and the shell may be approximately 2½ ft. long. When it is made of plastic, it is of very light weight and easily manipulated.

The outlet hose 26 may be quickly attached. The entire unit can be applied to a boat in a matter of a very few minutes.

The motors of motorboats usually have a great amount of power, and they are very effective for pumping water as described, and for great distances. In the case of vacation resorts, it has been recognized for a long time that the danger of fire is very great and the capabilities for putting it out are relatively small. Heretofore in order to effectively reach all fires, it was necessary to have a pump made for the purpose and on a trailer that could be moved along the shore. However, such pumps were relatively small so as to be easily manhandled, and those pump motors were without the desired power. However, a motorboat has great power, as referred to above, and the boat can be quickly moved along the water, if there is not already a motorboat at the immediate location of the fire.

The device is extremely useful for purposes other than extinguishing fires. It can be used for any purpose where it is desired to have water pumped, such as onto a lawn, or onto a weak ice spread to thicken or reinforce the ice. Obviously it may be used for any other of a wide variety of purposes.

Figure 7:
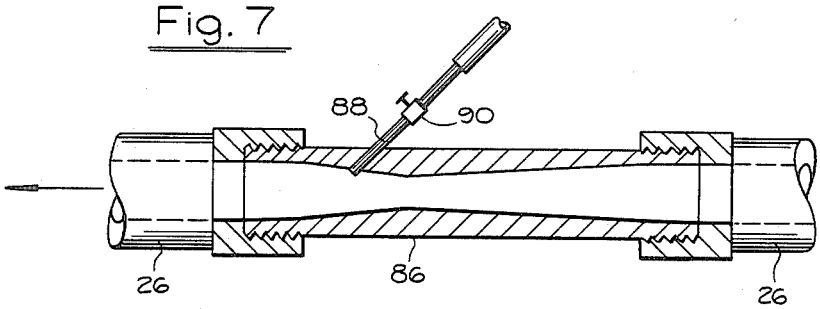
FIG. 7 is a detail view of a venturi that may be interposed in the outlet line of the emergency pump.

FIG. 7 shows a venturi 86, of known kind, interposed in the outlet hose 26 used for introducing a fire extinguishing chemical, if desired, through an inlet tube 88 having a control valve 90. Also, instead of such chemicals, insecticides may be introduced, in watering orchards, gardens, etc.

The construction of FIGS. 1–3 shows the preferred form, directing the flow of water longitudinally axially through the shell. However, the invention is not limited to such an arrangement, and attention is directed to FIG. 8, which shows a shell 92 corresponding with the shell 32, but having a tangential outlet 94. In this case, vanes such as 74 in FIGS. 3 and 4 are not utilized.

Figure 9:
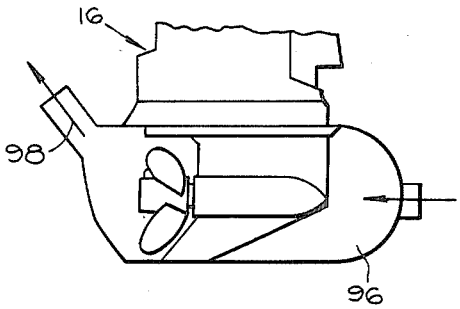
FIG. 9 is a view, partially broken away, of an emergency pump having an outlet that is directed at an angle to the longitudinal, but lying in the plane of a diameter of the pump.

Additionally the outlet may be arranged as viewed in FIG. 9, if desired, instead of as in the previous two arrangements, where the shell 96, corresponding to the shells 32, 92, includes an outlet 98 disposed at an angle to the longitudinal axis 41 of the shell, and lying in a diametrical plane containing that axis. Also in this construction, internal vanes are not utilized.

Figure 10:
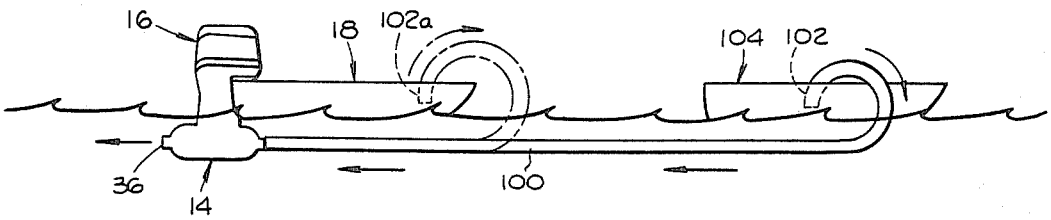
FIG. 10 is a diagrammatic view of the emergency pump as used in bailing boats.

FIG. 10 shows the device used for bailing a boat. This figure includes the boat 18 with the unit 14 applied thereto. An inlet hose 100 is secured to the inlet element 38 (FIG. 2) and the extended end 102 thereof is inserted in a boat 104. Upon operation of the motor, the water in the boat is bailed out by the device, and it is discharged through the outlet 36, and in this case it is not necessary to have an outlet hose such as 26.

The device can also be used for bailing the same boat on which it is mounted, 18. In this case the terminal of the hose 100 as indicated 102*a*, is inserted in the boat 18.

I claim:

1. A pump unit for a motorboard having a screw disposed in the water when the motorboat is in the water, the screw constituting a propeller for moving the boat along in the water and constituting an impeller when the pump unit claimed hereinbelow is applied thereto, the motorboat also having a structure mounting the screw, the axis of rotation of the screw determining a longitudinal direction extending fore and aft, said pump unit comprising, a shell made up of a pair of halves capable of being put in an operable position laterally on opposite sides of a vertical plane containing the axis of rotation of the screw and having a longitudinal direction, and when in said operable position extending longitudinal fore and aft beyond the screw, and enclosing the screw entirely except for water intake and outlet openings referred to below, the halves when in said operable and enclosing position being interconnected at locations at the bottom and at the top, the shell halves being detachably so interconnected at at least one of their locations of interconnection, whereby to enable the shell to be detachably put in its said operable position, the shell when in its said operable position having its longitudinal direction lying in the direction of the axis of rotation of the screw, the shell halves having conformations operable, when the halves are in their said operable and enclosing position, for forming a water intake opening and a water outlet opening at fore and aft ends of the shell, said conformations being adapted for connection thereto of water lines communicating with said openings respectively, the shell halves being held in said operable and enclosing position solely by the interconnection therebetween and consequent confinement therebetween of elements of said mounting structure, to the exclusion of any other connections between either of the halves and said mounting structure, the shell halves having conformations engagable with said mounting structure when the shell is in its said operable and enclosing position, preventing displacement of the shell in all directions.

2. A pump unit according to claim 1 wherein, at least the water inlet opening is in an end of the shell, enabling water to flow therethrough in longitudinal direction.

3. A pump unit according to claim 1 wherein, at least the water outlet opening is in an end of the shell enabling water to flow therethrough in longitudinal direction.

4. A pump unit according to claim 1 wherein, at least the water outlet opening is displaced from an end of the shell, positioned for and enabling water to flow therethrough in direction tangential relative to the axis of rotation of the screw.

5. A pump unit according to claim 1 wherein, the water inlet and outlet openings are coaxial with the screw.

6. A pump unit according to claim 5 wherein, the end of the shell containing the water outlet opening is spaced longitudinally from the screw, and the shell is provided with interior, longitudinal vanes extending from a position adjacent the screw to the water outlet opening operable, in the space within the transverse projection of the vanes, for directing the flow of water in longitudinal direction.

7. A pump unit according to claim 1 wherein, the mounting structure includes elements above and below the screw, respectively, and wherein, the shell halves engage those elements at corresponding positions above and below the screw, whereby the shell is prevented from moving in rotational direction relative to said axis.

8. A pump unit according to claim 1 wherein, the shell, includes a main circular portion longer than said lower unit and thereby having end portions disposed longitudinally beyond said lower unit, and locking means positioned on said end portions.

* * * * *